US010851539B2

(12) United States Patent
Allen et al.

(10) Patent No.: US 10,851,539 B2
(45) Date of Patent: Dec. 1, 2020

(54) BRIDGING TERMINATION CLIP

(71) Applicant: Allen Innovations, LLC, Cary, NC (US)

(72) Inventors: Brian C. Allen, Raleigh, NC (US); Richard Mountcastle, Raleigh, NC (US)

(73) Assignee: ALLEN INNOVATIONS, LLC, Cary, NC (US)

( * ) Notice: Subject to any disclaimer, the term of this patent is extended or adjusted under 35 U.S.C. 154(b) by 9 days.

(21) Appl. No.: 15/865,865

(22) Filed: Jan. 9, 2018

(65) Prior Publication Data

US 2018/0202144 A1 Jul. 19, 2018

Related U.S. Application Data

(60) Provisional application No. 62/446,761, filed on Jan. 16, 2017.

(51) Int. Cl.
*E04B 1/38* (2006.01)
*E04B 1/41* (2006.01)
(Continued)

(52) U.S. Cl.
CPC ..... *E04B 1/40* (2013.01); *E04B 1/5818* (2013.01); *E04B 2/58* (2013.01); *E04B 2/7457* (2013.01);
(Continued)

(58) Field of Classification Search
CPC . E04B 1/40; E04B 1/5818; E04B 2/58; E04B 2/7457; E04B 2/767;
(Continued)

(56) References Cited

U.S. PATENT DOCUMENTS 3,216,160 A * 11/1965 Best ..... E04F 11/028 52/189
3,457,689 A 7/1969 Troutner
(Continued)

OTHER PUBLICATIONS

FastBridge Clip, posted at clarkdietrich.com, posting date not given, [online], [site visited Mar. 29, 2018]. Available from Internet, URL: https ://www.clarkdietrich.com/products/bridging-bracing-backing-connections/fastbridge-clip-fb33-fb43-fb68 (Year: 2018).
(Continued)

*Primary Examiner* — Brian E Glessner
*Assistant Examiner* — James J Buckle, Jr.
(74) *Attorney, Agent, or Firm* — Ward and Smith, P.A.; Ryan K. Simmons

(57) ABSTRACT

A bridging termination clip for securing the terminal end of a steel channel or spazzer bar to a steel stud. The bridging termination clip may include a horizontal portion having a bridge plate and a pair of opposing legs, the legs extending vertically one from each side edge of the bridge plate in a substantially perpendicular relation thereto; a vertical plate connected to a rear portion of the bridge plate and extending upward in a substantially perpendicular relation thereto; and an opposing pair of side extensions connected to the vertical plate and extending rearward one from each side of the vertical plate in a substantially perpendicular relation thereto.

17 Claims, 10 Drawing Sheets

(51) Int. Cl.

| | |
|---|---|
| ***E04B 2/76*** | (2006.01) |
| ***E04B 2/58*** | (2006.01) |
| ***E04B 2/74*** | (2006.01) |
| ***E04B 1/58*** | (2006.01) |

(52) U.S. Cl.
CPC ..... *E04B 2/767* (2013.01); *E04B 2001/405* (2013.01)

(58) Field of Classification Search
CPC ..... E04B 2001/405; E04B 1/24; E04B 2/721; E04B 2/761; E04B 2/762; E04B 2/789; E04B 2001/2415; E04B 2001/2448; E04C 2003/026; E04C 2003/0473; E04C 3/09
USPC ..... 52/696, 712; 403/388, 399
See application file for complete search history.

(56) References Cited

U.S. PATENT DOCUMENTS

| | | | | | |
|---|---|---|---|---|---|
| 3,604,176 | A * | 9/1971 | Campbell | E04B 1/5818 | 52/660 |
| 3,902,298 | A * | 9/1975 | Ratliff, Jr. | E04B 1/2612 | 403/188 |
| 3,945,741 | A | 3/1976 | Wendt | | |
| 4,665,677 | A | 5/1987 | Palacio | | |
| 5,364,312 | A * | 11/1994 | Cunard | A63G 9/00 | 182/153 |
| D357,623 | S | 4/1995 | Davis | | |
| 5,403,110 | A | 4/1995 | Sammann | | |
| 5,457,928 | A * | 10/1995 | Sahnazarian | E04B 1/2612 | 403/232.1 |
| 5,784,850 | A * | 7/1998 | Elderson | E04B 2/789 | 403/375 |
| 5,904,023 | A * | 5/1999 | diGirolamo | E04B 2/7457 | 403/388 |
| 6,708,460 | B1 * | 3/2004 | Elderson | E04B 2/7457 | 403/353 |
| 6,920,734 | B2 * | 7/2005 | Elderson | E04B 2/58 | 403/375 |
| 7,104,024 | B1 * | 9/2006 | diGirolamo | E04B 2/767 | 403/231 |
| 7,168,219 | B2 * | 1/2007 | Elderson | E04B 2/58 | 52/481.2 |
| D573,873 | S * | 7/2008 | Wall | D8/354 | |
| D611,887 | S | 3/2010 | Peschmann | | |
| 7,730,695 | B2 * | 6/2010 | Brady | E04B 2/7457 | 52/696 |
| 7,739,852 | B2 * | 6/2010 | Brady | E04B 2/7457 | 52/27 |
| D692,746 | S | 11/2013 | Lawson | | |
| 8,683,772 | B2 * | 4/2014 | Friis | E04B 7/022 | 52/691 |
| 8,733,061 | B1 | 5/2014 | McDonald | | |
| 8,925,893 | B2 * | 1/2015 | Biedenweg | B60P 7/0807 | 248/500 |
| 9,016,024 | B1 * | 4/2015 | Daudet | E04B 2/763 | 52/643 |
| D730,545 | S | 5/2015 | Stauffer | | |
| D732,708 | S | 6/2015 | Stauffer | | |
| 9,091,056 | B2 * | 7/2015 | Stauffer | E04B 1/40 | |
| 9,290,928 | B2 * | 3/2016 | Klein | E04B 1/40 | |
| 9,523,196 | B2 * | 12/2016 | Rice | E04B 2/62 | |
| D791,578 | S | 7/2017 | Royak | | |
| 9,732,520 | B2 | 8/2017 | Daudet | | |
| D796,302 | S | 9/2017 | Bright | | |
| D798,693 | S | 10/2017 | Kanagal Narasimhaswamy | | |
| 9,849,497 | B2 | 12/2017 | Daudet | | |
| D820,664 | S * | 6/2018 | Allen | D8/354 | |
| D821,851 | S | 7/2018 | Stahl | | |
| D822,455 | S | 7/2018 | Stahl | | |
| D823,095 | S | 7/2018 | Stahl | | |
| 2002/0046525 | A1 * | 4/2002 | Rice | E04B 2/7457 | 52/481.1 |
| 2002/0059773 | A1 * | 5/2002 | Elderson | E04B 2/58 | 52/667 |
| 2003/0089053 | A1 * | 5/2003 | Elderson | E04B 2/58 | 52/204.1 |
| 2008/0053034 | A1 * | 3/2008 | Matechuk | E04B 1/24 | 52/702 |
| 2008/0245025 | A1 * | 10/2008 | Slater | E04B 1/24 | 52/696 |
| 2014/0270916 | A1 | 9/2014 | Daudet | | |
| 2014/0270923 | A1 | 9/2014 | Daudet | | |
| 2016/0002912 | A1 | 1/2016 | Doupe | | |
| 2016/0069072 | A1 * | 3/2016 | Rice | E04B 2/62 | 52/696 |
| 2018/0154421 | A1 | 6/2018 | Daudet et al. | | |
| 2018/0266109 | A1 | 9/2018 | Haba | | |

OTHER PUBLICATIONS

Simpson Strong Tie SUBH3, posted at amazon.com, posting date Dec. 4, 2013, [online], [site visited Mar. 29, 2018]. Available from Internet, URL: https://www.amazon.com/Simpson-Strong-SUBH3-25-R150-Bridging-Connector/dp/BOOH3NWLPE (Year: 2013).

Spazzer Bar Fly Clip, posted at clarkdietrich.com, posting date not given, [online], [site visited Mar. 29, 2018]. Available from Internet, URL: https://www.clarkdietrich.com/products/bridging-bracing-backing-connections/spazzer-bar-fly-clip-sfly (Year: 2018).

Universal Bridging Clip, posted at bmp-group.com, posting date not given, [online], [site visited Mar. 29, 2018]. Available from Internet, URL: http://www.bmp-group.com/products/framing-connectors-clips/universal-bridging-clip-(ubc-365-ubc-600-ubc800) (Year: 2018).

BC Secure Bridge Clip, posted at scafco.com, posting date not given, [online], [site visited Oct. 12, 2018], Available from Internet, URL: https://www.scafco.com/steel/products/secure-clips/bc-secure-bridge-clip/ (Year: 2018).

DBC Drywall Bridging Connector, posted at sssuply.com, posting date not given, [online], [site visited Oct. 12, 2018], Available from Internet, URL: http://www.sssupply.com/product/DBC_Drywall_Bridging_Connector (Year: 2018).

Two-Position Bridging Clip, posted at grainger.com, posting date not given, [online], [site visited Oct. 12, 2018], Available from Internet, URL: https://www.grainger.com/product/LEVITON-Two-Position-Bridging-Clip-5LP91 (Year: 2018).

* cited by examiner

BRIDGING TERMINATION CLIP

RELATED APPLICATIONS

This application claims priority to and incorporates herein by reference related U.S. Provisional Patent Application No. 62/446,761, entitled "Bridging Termination Clip" filed on Jan. 16, 2017.

TECHNICAL FIELD

This invention relates to steel stud building wall systems, specifically, to a steel stud bridging termination clip for stabilizing steel studs to prevent movement and twisting in such systems.

BACKGROUND

Many commercial, industrial buildings and increasing number of residential buildings are being constructed with steel stud wall framing. When building a wall with metal studs it is necessary to ensure that the studs are held in fixed positions relative to each other and to also prevent twisting, bending, or other unwanted movement. When the studs twist or bend, due to wind or other influences, they can effectively lose their ability to resist these impaired loads, thus weakening their structural integrity. In steel stud walls, a steel channel is typically inserted horizontally through openings in each of the vertically disposed studs to help keep the studs aligned as well as to provide additional structural support. The steel studs have relatively good columnar strength when straight, but when twisted or bent, the stud loses a significant portion of their structural integrity. The steel channel fits through the openings at engineered spacing, and is secured to the steel studs to help minimize unwanted twisting of the steel framing. A common missing element in the use of this stabilizing channel is at all termination points of this channel in the wall structure. This occurs primarily at window or door openings, and at the corners of the wall structure, however is not limited to these situations. At a window or door opening, the vertical steel stud member defining the outer opening is known as a jamb stud. It is just as important, if not more so, to keep this jamb stud member from twisting or other movement. Currently there is no good or consistent method for attachment of the stabilizing channel to the jamb stud for its stability. At the terminal end, the steel stud does not have the benefit of the channel passing through it with additional steel studs on either side to help provide added support. Rather the jamb stud or corner wall stud is the terminal stud and the channel needs attachment to these members to secure the framing integrity. A variety of field modified components are currently used for this terminating attachment. However to design and engineer an adequate attachment for this critical juncture, a consistent attachment mechanism is needed for design purposes.

It is therefore an object of the present invention to provide a termination clip which provides additional support and is easy to install for use with steel studs, such as jamb studs, building corner studs, and/or other terminating conditions to the stabilizing steel channel.

Other objects and advantages will be more fully apparent from the following disclosure and appended claims.

SUMMARY

In one embodiment, a bridging termination clip is provided. The bridging termination clip may include a horizontal portion having a bridge plate and a pair of opposing legs, the legs extending vertically one from each side edge of the bridge plate in a substantially perpendicular relation thereto; a vertical plate connected to a rear portion of the bridge plate and extending upward in a substantially perpendicular relation thereto; and an opposing pair of side extensions connected to the vertical plate and extending rearward one from each side of the vertical plate in a substantially perpendicular relation thereto. The horizontal portion may be generally shaped in the form of an inverted U. The opposing legs may be configured and separated by a distance sufficient to allow a channel to be positioned therebetween. The spacing between the opposing pair of side extensions may be substantial equal to or slightly greater than a width of a stud. The bridging termination clip may further include a set of opposing vertical extensions, wherein each of the vertical extensions may be inset about an equal distant from opposing sides of the bridge and extending vertically downward from a bottom surface of the bridge plate in a substantially perpendicular relation thereto, and wherein a spacing between the opposing vertical extensions may be substantially equal to or slightly greater than a width of a channel. The spacing between the vertical extensions may be about 1½ inches. The bridging termination clip may further include one or more holes formed in one or more of the bridge plate, legs, vertical plate, and side extensions. The horizontal portion may narrow in width along its length. The horizontal portion may be about 3 inches in length or longer; the width between the opposing side extensions may be in the range of about 3⅝ inches to about 12 inches wide; and the width between the opposing legs at its narrowest point may be about 1½ inches wide or wider. In one embodiment, the horizontal portion may be substantially the same width along its length. The horizontal portion may be about 3 inches in length; the width between the opposing side extensions may be in the range of about 3⅝ inches to about 12 inches wide; and the width between the opposing legs may be about 1½ inches wide.

In another embodiment, an alternative embodiment of a bridging termination clip is provided. The bridging termination clip may include a horizontal portion having a pair of legs connected along a peak, the legs extending downward from the peak at an angle relative to one another to form a generally inverted V shape; a vertical plate connected to a rear portion of the horizontal portion and extending upward in a substantially perpendicular relation thereto; and an opposing pair of side extensions connected to the vertical plate and extending rearward one from each side of the vertical plate in a substantially perpendicular relation thereto. The legs may be configured to allow a V shaped channel to be positioned therebetween. The spacing between the opposing pair of side extensions may be substantial equal to or slightly greater than a width of a stud. The legs may be angled at about 45 degrees relative to a vertical center of the peak. The bridging termination clip may further include one or more holes formed in one or more of the legs, vertical plate, and side extensions. The horizontal portion may be about 1½ inches in length or longer; the width between the opposing side extensions may be in the range of about 3⅝ inches to about 12 inches wide; and the width between a lower edge of the legs may be about 1¾ inches wide.

In another embodiment, a method of securing a terminal end of a channel to a stud using a bridging termination clip is provided. The method may include securing a first portion of the bridging termination clip to a terminal end of a channel; and securing a second portion of the bridging termination clip to a stud. The bridging termination clip may include a horizontal portion having a bridge plate and a pair of opposing legs, the legs extending vertically one from each side edge of the bridge plate in a substantially perpendicular relation thereto; a vertical plate connected to a rear portion of the bridge plate and extending upward in a substantially perpendicular relation thereto; and an opposing pair of side extensions connected to the vertical plate and extending rearward one from each side of the vertical plate in a substantially perpendicular relation thereto. The first portion may include the horizontal portion and the second portion may include at least one of the vertical plate and the side extensions. The bridging termination clip may alternatively include a horizontal portion having a pair of legs connected along a peak, the legs extending downward from the peak at an angle relative to one another to form a generally inverted V shape; a vertical plate connected to a rear portion of the horizontal portion and extending upward in a substantially perpendicular relation thereto; and an opposing pair of side extensions connected to the vertical plate and extending rearward one from each side of the vertical plate in a substantially perpendicular relation thereto. The first portion comprises the horizontal portion and the second portion comprises at least one of the vertical plate and the side extensions.

Certain aspects of the subject matter of the invention having been stated hereinabove, which are addressed in whole or in part by the disclosed subject matter, other aspects will become evident as the description proceeds when taken in connection with the accompanying Examples and Drawings as best described herein below.

BRIEF DESCRIPTION OF THE DRAWINGS

Having thus described the subject matter of the invention in general terms, reference will now be made to the accompanying Drawings, which are not necessarily drawn to scale, and wherein:

FIGS. 1A, 1B, 1C, 1D, and 1E illustrate a top view, rear perspective view, bottom perspective view, front view, and side view, respectively, of a bridging termination clip according to an embodiment of the invention.

Figure 1A:
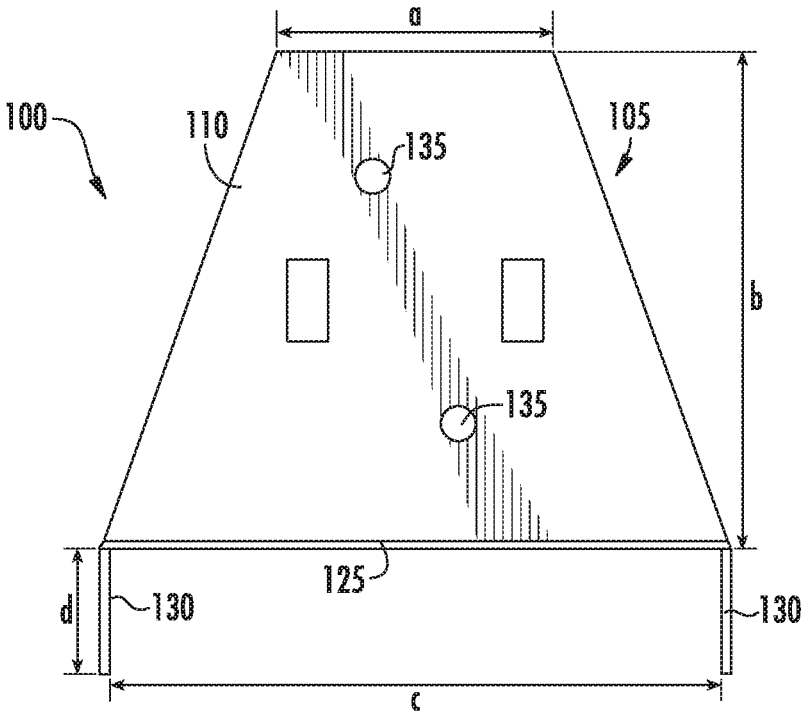
Figure 1B:
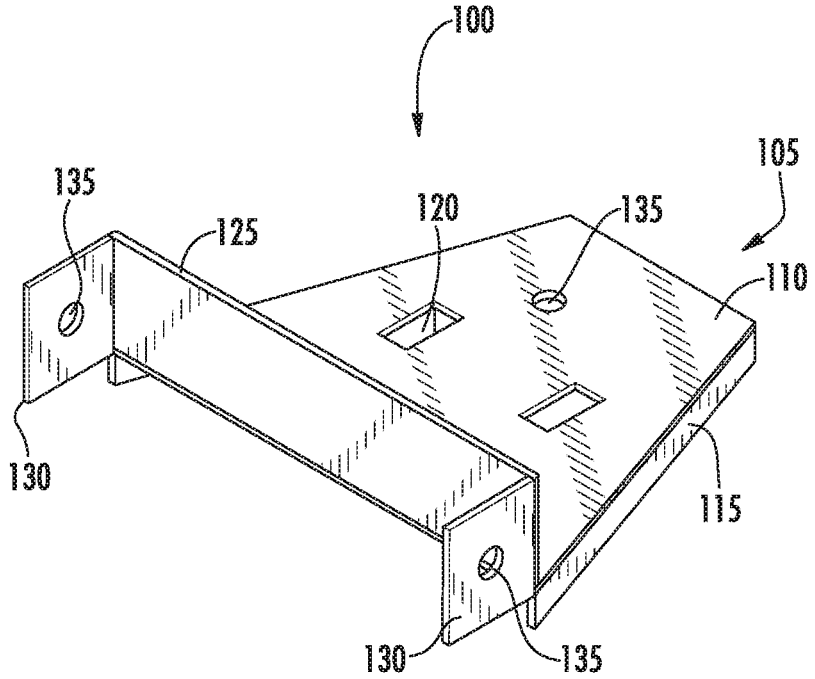
Figure 1C:
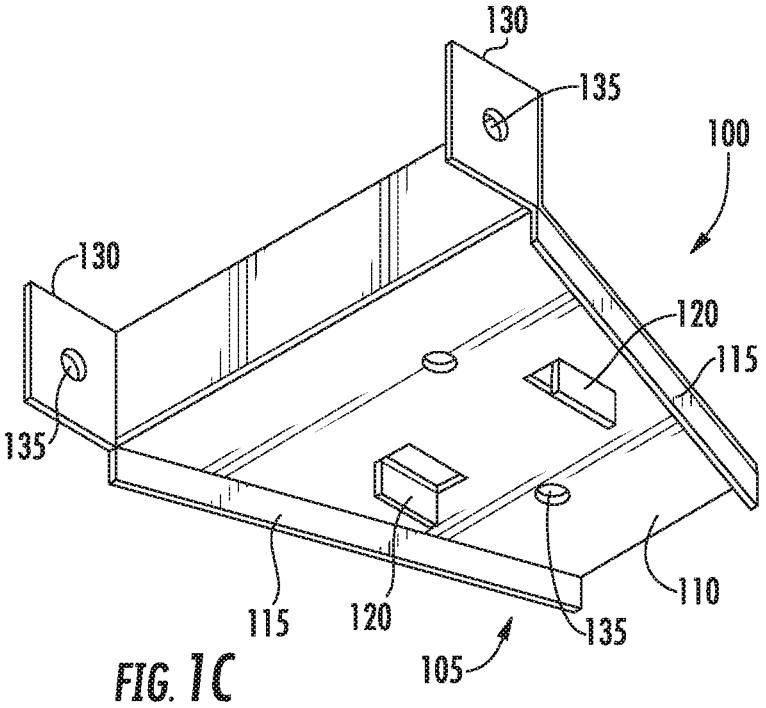
Figure 1D:
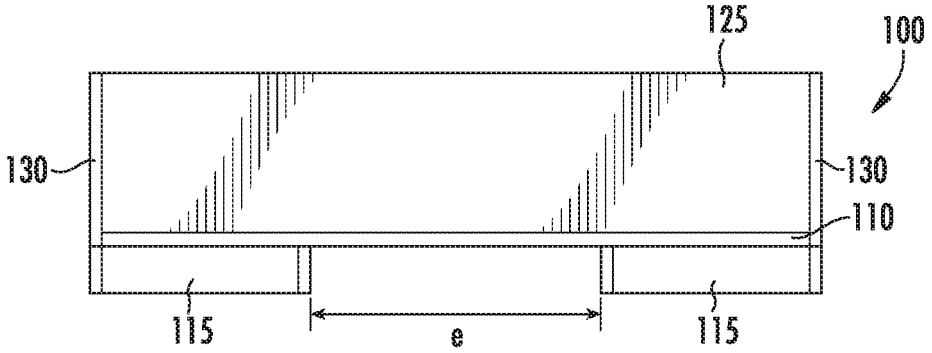
Figure 1E:
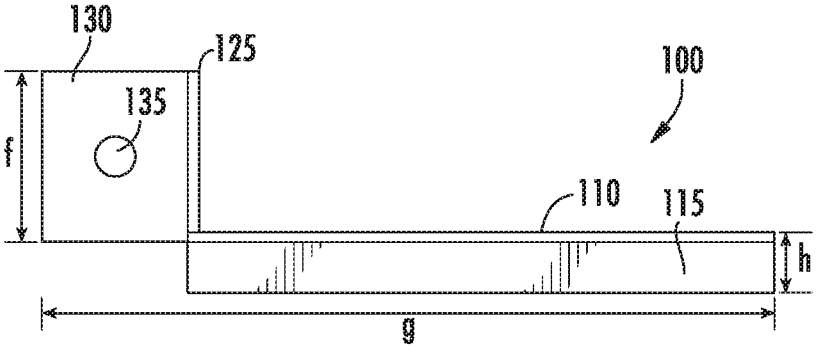
Figure 2A:
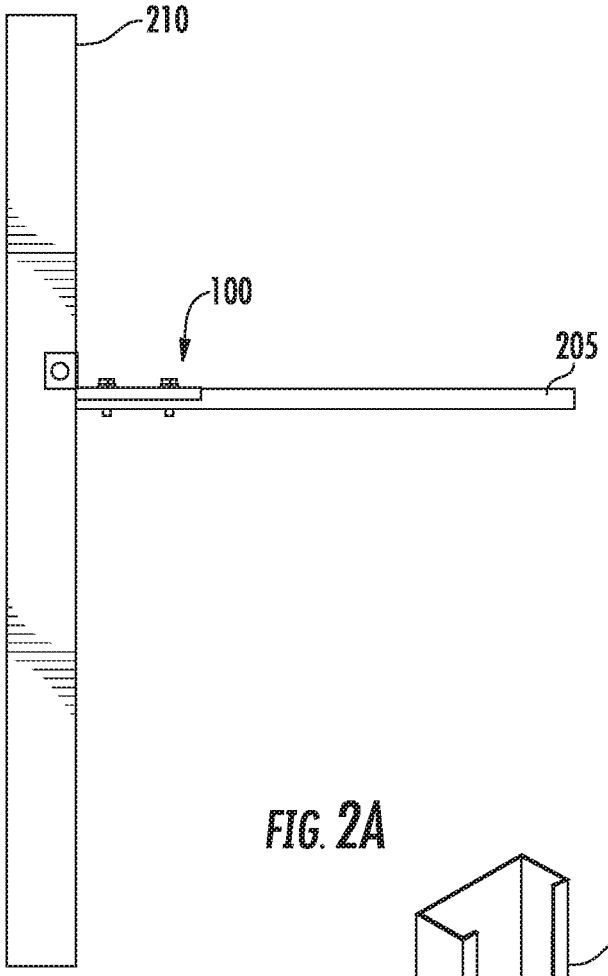
Figure 2B:
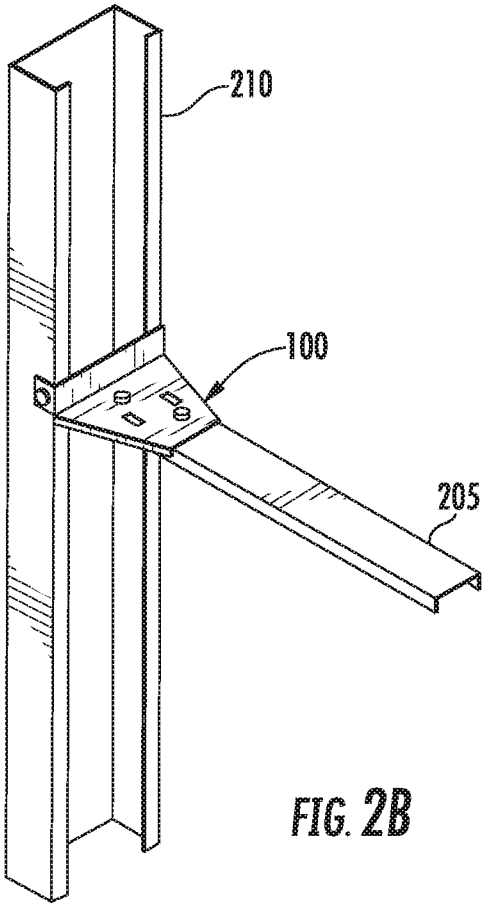

FIGS. 2A and 2B illustrate a side view and a perspective view, respectively, of a portion of a steel channel connected to a single steel stud at its terminal end via the bridging termination clip of FIGS. 1A-1E.

Figure 3A:
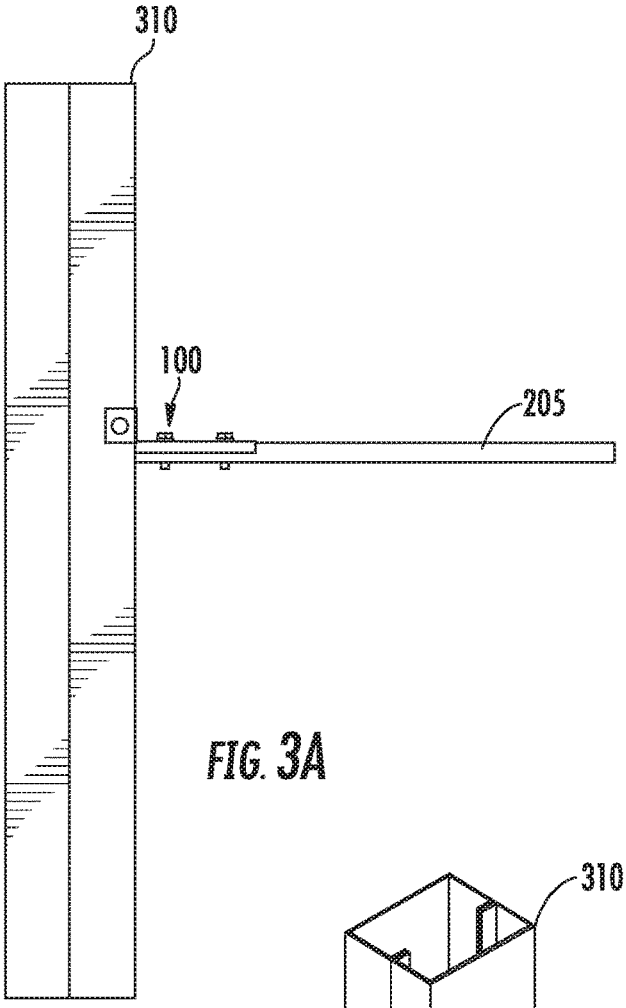
Figure 3B:
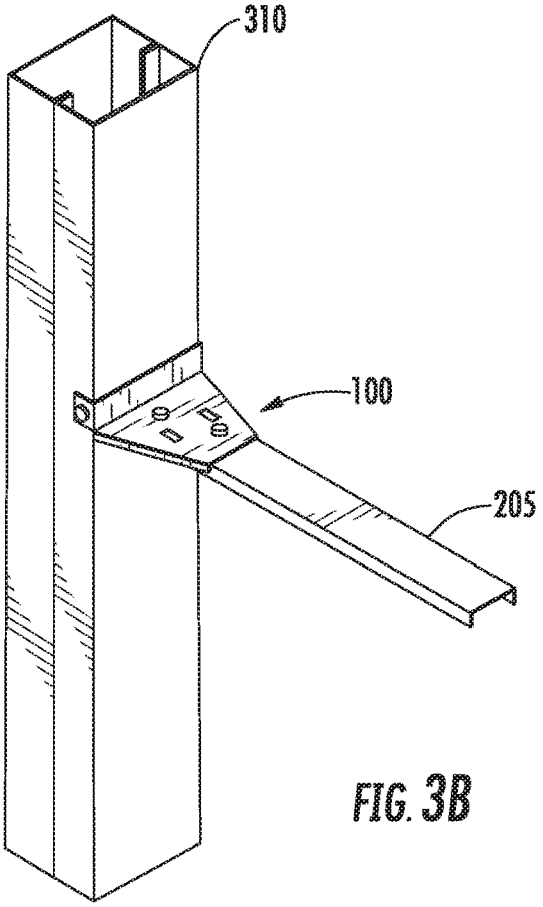
Figure 4A:
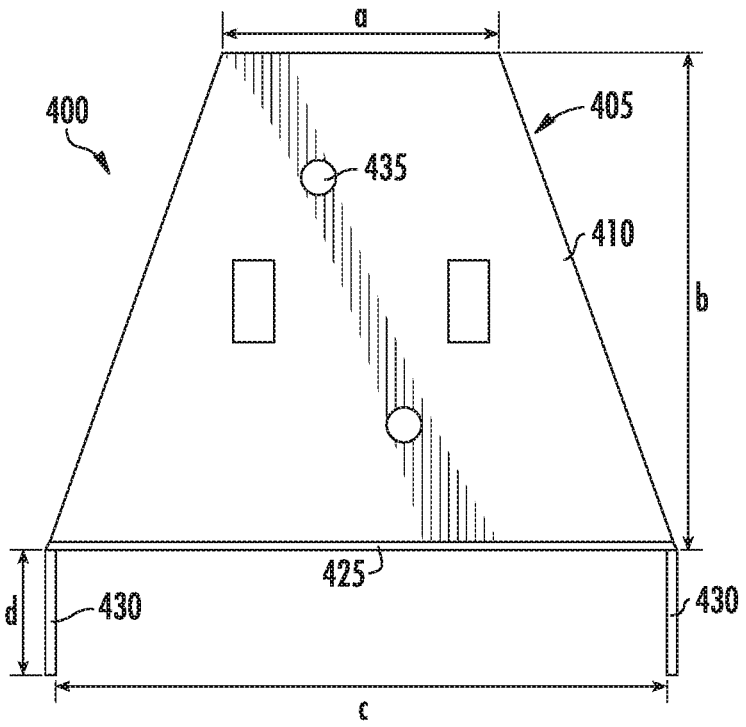
Figure 4B:
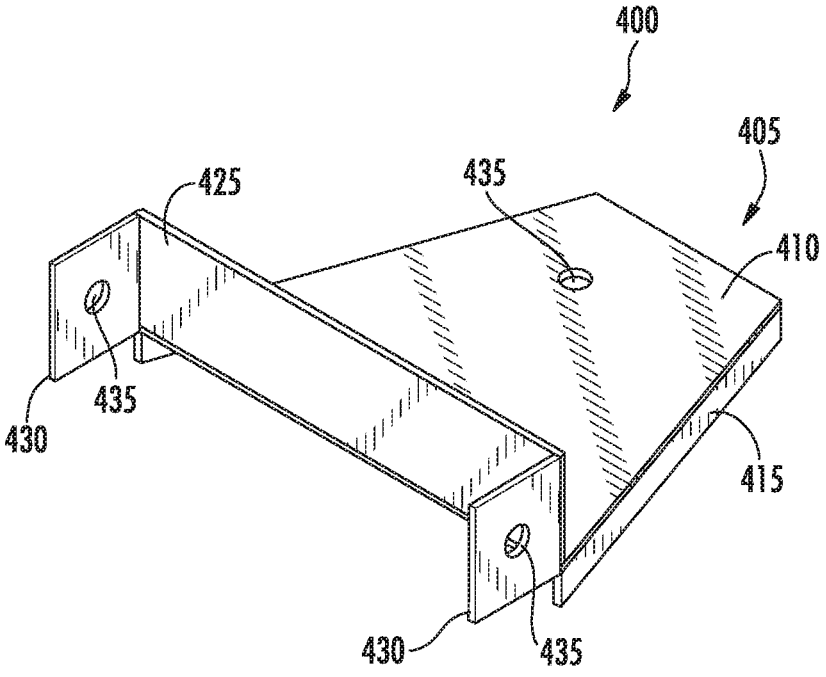
Figure 4C:
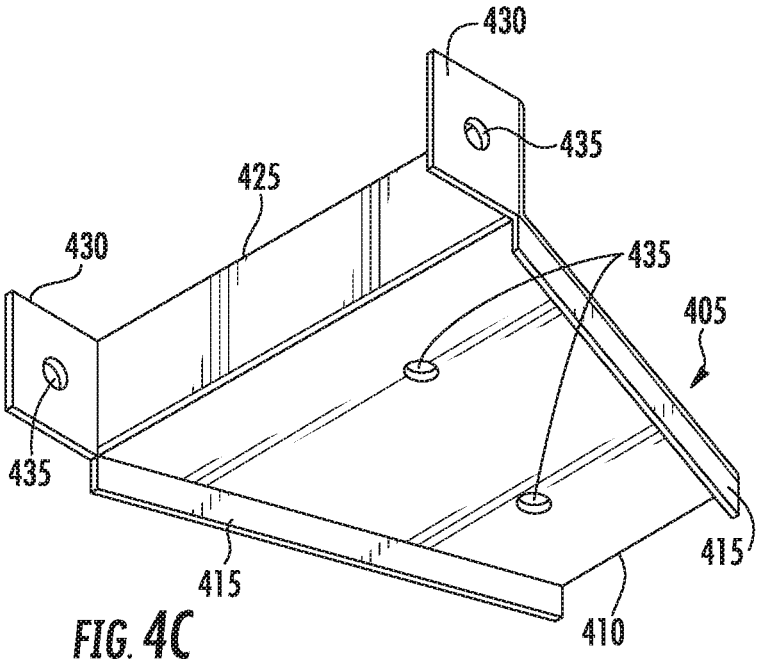
Figure 4D:
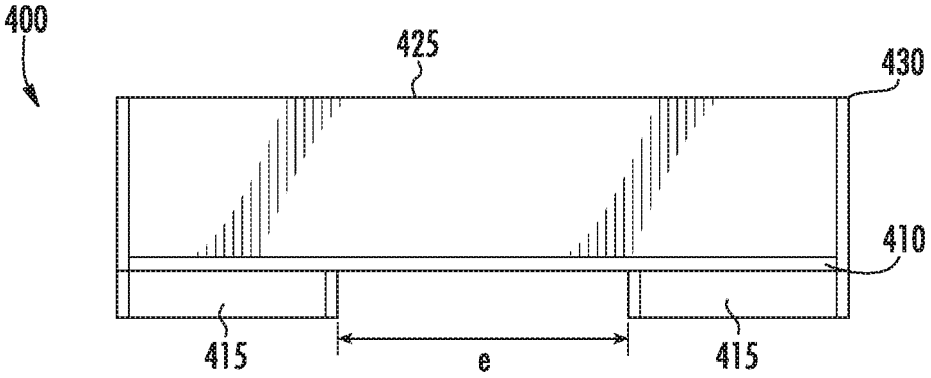
Figure 4E:
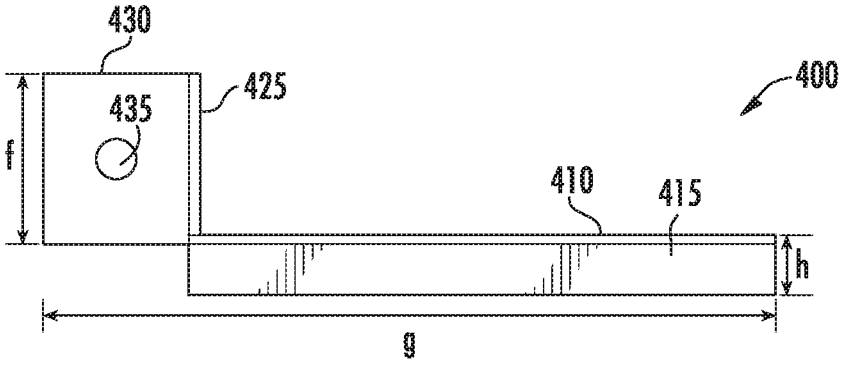
Figure 5A:
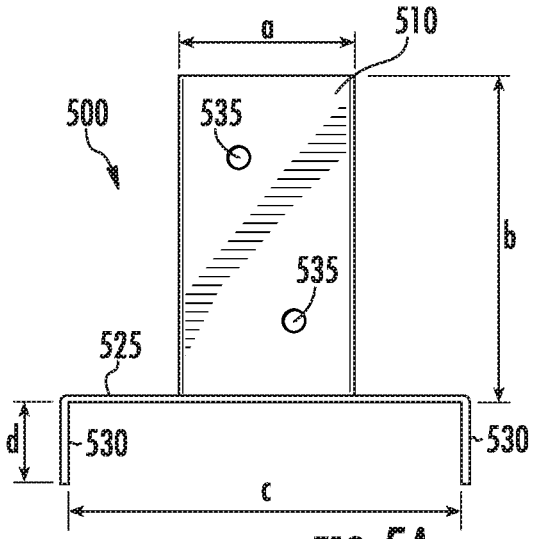
Figure 5B:
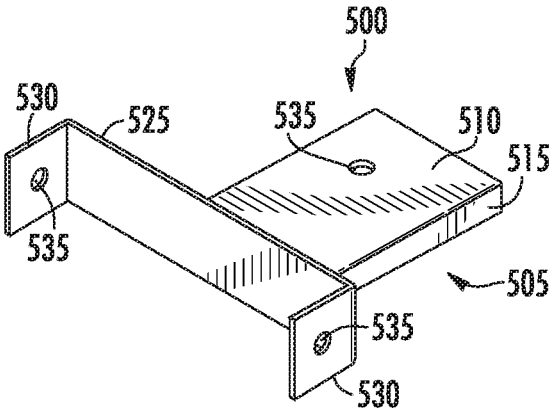
Figure 5C:
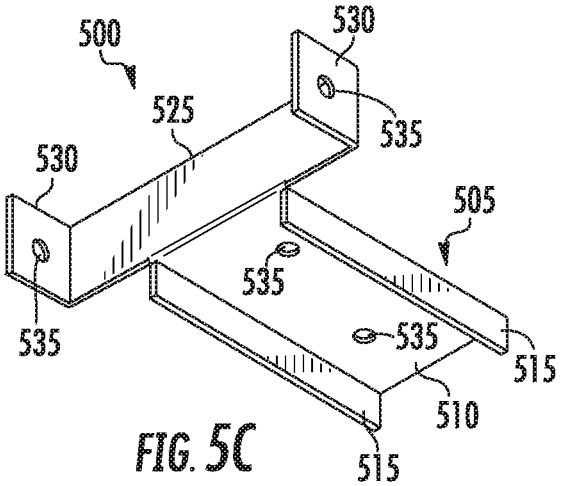
Figure 5D:
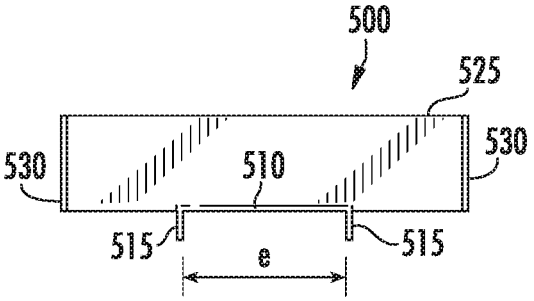
Figure 5E:
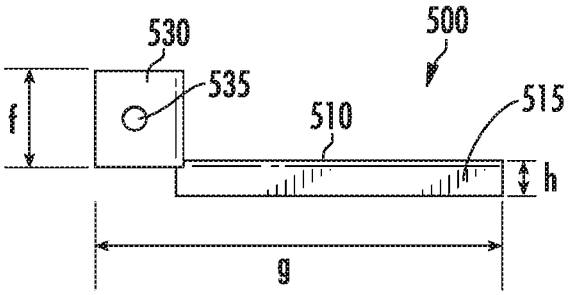
Figure 6A:
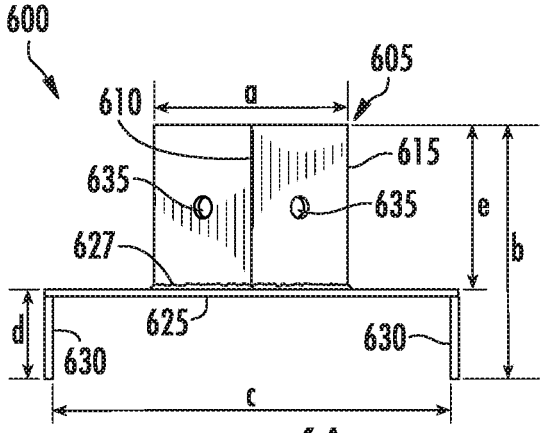
Figure 6B:
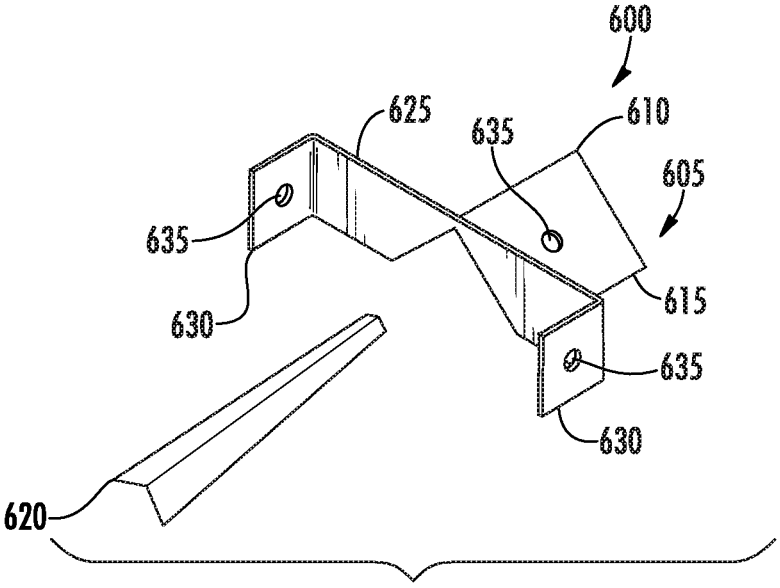
Figure 6C:
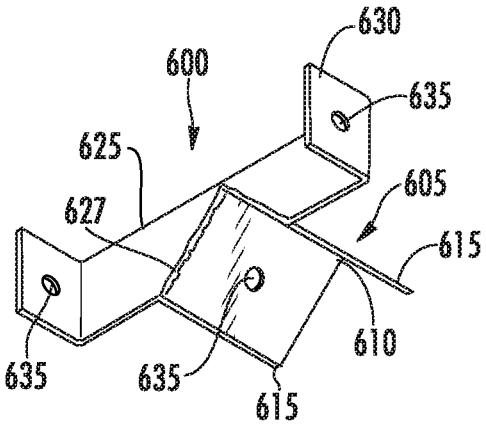
Figure 6D:
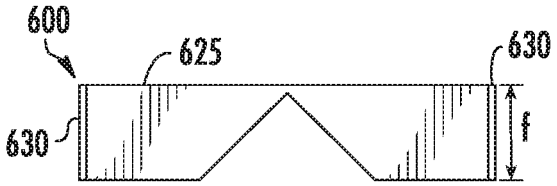
Figure 6E:
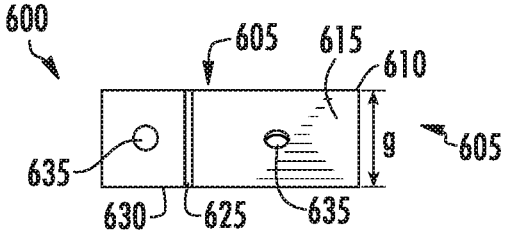
Figure 6F:
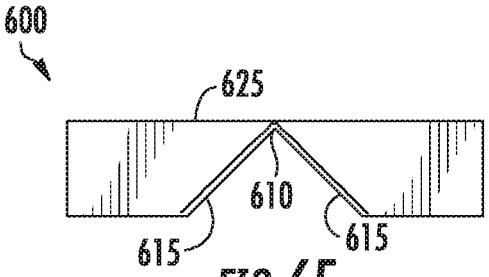
Figure 6G:
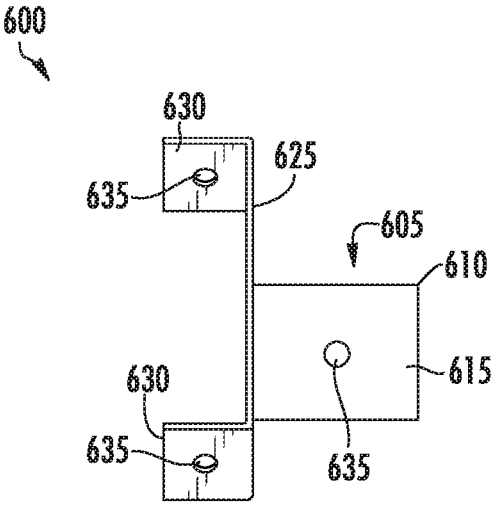

FIGS. 3A and 3B illustrate a side view and a perspective view, respectively, of a portion of a steel channel connected to a double steel stud at its terminal end via the bridging termination clip of FIGS. 1A-1E.

FIGS. 4A, 4B, 4C, 4D, and 4E illustrate a top view, rear perspective view, bottom perspective view, front view, and side view, respectively, of a bridging termination clip according to another embodiment of the invention.

FIGS. 5A, 5B, 5C, 5D, and 5E illustrate a top view, rear perspective view, bottom perspective view, front view, and side view, respectively, of a bridging termination clip according to yet another embodiment of the invention.

FIGS. 6A, 6B, 6C, 6D, 6E, 6F, and 6G illustrate a top view, rear perspective view, bottom perspective view, rear view, side view, front view, and rotated side view, respectively, of a bridging termination clip according to still yet another embodiment of the invention.

Figure 7A:
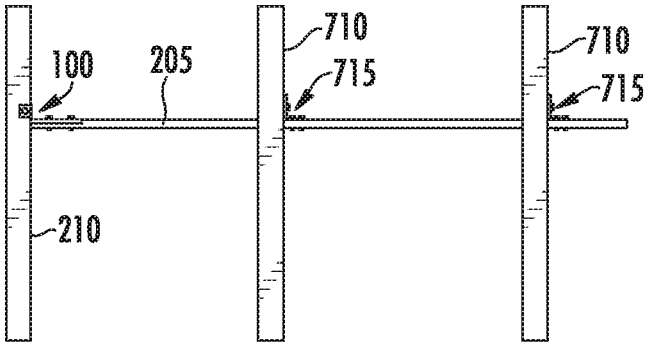
Figure 7B:
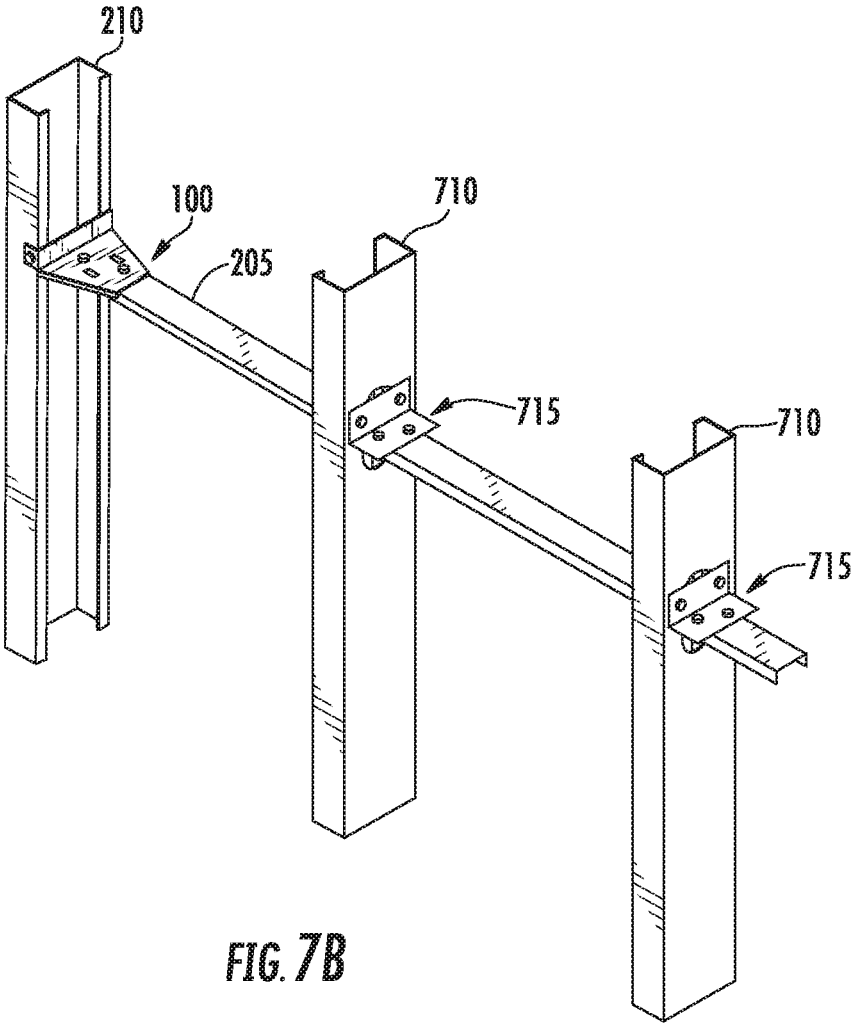

FIGS. 7A and 7B illustrate views of a portion of a steel channel inserted perpendicularly through openings of two consecutive steel studs and connected to a steel stud at its terminal end via the bridging termination clip of FIGS. 1A-1E.

DETAILED DESCRIPTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

Referring now to FIGS. 1A-1E, illustrate views of a bridging termination clip 100. Bridging termination clip 100 includes a horizontal channel portion 105 that is in the general shape of an inverted "U". Horizontal channel portion 105 includes a horizontal bridge 110 and legs 115. Legs 115 extend vertically downward from opposing side edges of bridge 110 in a substantially perpendicular relation thereto. Horizontal channel portion 105 may further include a set of opposing vertical extensions 120. Vertical extensions 120 may be each inset about an equal distant from each side of bridge 110 and extend vertically downward from a bottom surface of horizontal bridge 110 in a substantially perpendicular relation thereto. The spacing between the opposing vertical extensions 120 may be such that a channel 205 (e.g., see FIG. 2), can fit between the opposing vertical extensions 120, that is the spacing between the opposing vertical extensions 120 may be substantially equal to or slightly greater than the width of channel 205, e.g., about 1½ inches.

Bridging termination clip 100 may further include a vertical plate 125 extending vertically upward from a rear edge of horizontal bridge 110 and is preferably oriented substantially perpendicular thereto. Vertical plate 125 may further include opposing side extensions 130 extending rearward, one from each opposing side of vertical plate 125 and oriented substantially perpendicular thereto. The spacing between side extensions 130 maybe substantially equal to or slightly greater than the width (e.g., outer or inner width) of a steel stud, such as single jamb steel stud 210 or double jamb steel stud 310 (e.g., see FIGS. 2 and 3), e.g., in the range of about 3⅝ inches to about 12 inches, such as, 3⅝ inches, 4 inches, 6 inches, 8 inches, 10 inches, 12 inches, or other width less than 3⅝ inches or greater than 12 inches, as required by a particular steel stud application. While single jamb steel stud 210 and double jamb steel stud 310 are listed above as example steel studs for an application of bridging termination clip 100, it shall be appreciated that bridging termination clip may be used with other steel studs, for example, corner wall studs or any other steel stud product to terminate bridging into.

Bridging termination clip 100 may further include one or more holes 135. In one example, one or more holes 135 are formed in horizontal bridge 110 and/or side extensions 130.

Holes 135 may be sized for the insertion of fasteners, e.g., screws, rivets, or the like for securing bridging termination clip 100 to a steel stud, for example, single jamb steel stud 210, double jamb steel stud 310, or any other steel stud product to terminate bridging into, and a channel, such as channel 205. Holes 135 may be pre-formed in bridging termination clip 100, e.g., at the time of fabrication, or may be formed at a later time, e.g., prior to or during use in the field. Holes 135 may further be formed in legs 115 and/or vertical plate 125.

In one example, horizontal channel portion 105 may narrow in width as it extends from its rear portion to its front portion, wherein at the front most portion horizontal channel portion 105 has a width between legs 115 that is equal to or slightly greater than the width of steel channel 205; and its width at its rearmost portion may be equal to or slightly greater than the width of the steel stud it is attached to, e.g., single jamb steel stud 210 or double jamb steel stud 310, and may be substantially the same width as the width of vertical plate 125.

In one example, bridging termination clip 100 may have the dimensions of about those as indicated in Table 1 below with reference to FIGS. 1A-1E. However, other suitable dimensions less than or greater than those listed below in Table 1 are contemplated.

TABLE 1

| | |
|---|---|
| a | 1⅝" |
| b | 3" |
| c | 3⅝", 4", 6", 8", 10", 12" |
| d | ¾" |
| e | 1½" |
| f | ⅞" |
| g | 3¾" |
| h | ¼" |

Bridging termination clip 100 may be formed of a single piece of sheet steel similar to the material of which a standard steel stud, such as single jamb steel stud 210, double jamb steel stud 310, and/or channel 205 are formed. The sheet may be bent to about a right angle between horizontal channel portion 105 and the vertical plate 125 portions. Other materials, such as, for example, plastics, and other suitable materials, may also be used.

Referring now to FIGS. 2A-2C and 3A-3C, illustrate views of a portion of a steel channel 205 connected to a steel stud such as single jamb steel stud 210 or double jamb steel stud 310 at its terminal end 215 via termination clip 100. Alternatively, single jamb steel stud 210 and double jamb steel stud 310 may be a corner steel stud or any other steel stud product to terminate bridging into. Single jamb steel stud 210, double jamb steel stud 310, and channel 205 may be made of sheet steel or other suitable material. In one example, single jamb steel stud 210, double jamb steel stud 310, and channel 205 may be made of sheet steel having a thickness of about 0.043 to 0.118 inches. In other examples, bridging termination clip 100 may be any one of bridging termination clips 400 (see FIGS. 4A-4E) or 500 (see FIGS. 5A-5E). In yet another example, steel channel 205 may be spazzer bar 620 (see FIGS. 6A-6G), and bridging termination clip 100 may be bridging termination clip 600 (see FIGS. 6A-6G).

The width between opposing vertical extensions 120 is preferably substantially equal to or slightly greater than the width of channel 205, such that channel 205 may fit between opposing vertical extensions 120. Channel 205 may preferably be installed between opposing vertical extensions 120 with its channel portion facing down, as shown in FIGS. 2A-2C and 3A-3C. The width between opposing side extensions 130 of vertical plate 125 is preferably substantially equal to or slightly greater than the width of the steel stud to which it is being attached, for example, single jamb steel stud 210, double jamb steel stud 310, or any other steel stud product to terminate bridging into, such that the steel stud, may fit between opposing side extensions 130. Bridging termination clip 100 is preferably secured to the steel stud, via one or more fasteners, e.g., screws, rivets or the like received through one or more of holes 135 formed, for example, in opposing side extensions 130. Channel 205 is preferably secured to bridging termination clip 100 via one or more fasteners, e.g., screws, rivets or the like received through one or more of holes 135 formed, for example, in horizontal bridge 110. In one example, fasteners, e.g., screws, rivets or the like are received through one or more of holes 135 formed, for example, in opposing side extensions 130, and driven into outer side portions of the steel stud, e.g., single jamb steel stud 210, double jamb steel stud 310, or other steel stud; and fasteners, e.g., screws, rivets or the like are received through one or more of holes 135 formed, for example, in horizontal bridge 110, and driven into a top portion of channel 205. Channel 205, as it is attached to the steel stud, e.g., single jamb steel stud 210, double jamb steel stud 310, or other steel stud, via bridging termination clip 100, will facilitate reduction in unwanted movement of any steel stud that the bridging is being terminated into.

Referring now to FIGS. 4A-4E, illustrate views of a bridging termination clip 400 according to a second embodiment. Bridging termination clip 400 includes a horizontal channel portion 405, which is in the general shape of an inverted "U", which includes a horizontal bridge 410 and opposing legs 415 extending vertically downward from side edges of bridge 110 in perpendicular relation thereto. Horizontal channel portion 405 may narrow in width as it extends from its rear portion to its front portion, wherein at its narrowest portion, e.g., the front most portion, has a width between legs 415 that is substantially equal to or slightly greater than the width of channel 205, such that channel 205 can fit between legs 415, and the width of channel 205 at its rearmost portion may be, in one example, substantially equal to or slightly greater than the width of a steel stud, such as single jamb steel stud 210 or double jamb steel stud 310, e.g., in the range of about 3⅝ inches to about 12 inches, such as, 3⅝ inches, 4 inches, 6 inches, 8 inches, 10 inches, 12 inches, or other width less than 3⅝ inches or greater than 12 inches, as required by a particular steel stud application. While single jamb steel stud 210 and double jamb steel stud 310 are listed above as example steel studs for an application of bridging termination clip 100, it shall be appreciated that bridging termination clip may be used with other steel studs, for example, corner wall studs or any other steel stud product to terminate bridging into.

Bridging termination clip 400 may further include a vertical plate 425 extending vertically upward from a rear portion of horizontal bridge 410 and oriented substantially perpendicular thereto. Vertical plate 425 may further include opposing side extensions 430 extending rearward, one from each side of vertical plate 425 and oriented substantially perpendicular thereto. The spacing between side extensions 430 maybe substantially equal to or slightly greater than the width (e.g., outer or inner width) of a steel stud, such as single jamb steel stud 210, double jamb steel stud 310, or any other steel stud product to terminate bridging into, e.g., in the range of about 3⅝ inches to about 12 inches, such as, 3⅝ inches, 4 inches, 6 inches, 8 inches, 10 inches, 12 inches, or other width less than 3⅝ inches or greater than 12 inches, as required by a particular steel stud application.

Bridging termination clip 400 may further include one or more holes 435 formed, for example, in horizontal bridge 410 and/or side extensions 430. Holes 435 may be sized for the insertion of fasteners, e.g., screws, rivets, or the like for securing bridging termination clip 400 to a steel stud, such as single jamb steel stud 210, double jamb steel stud 310 or other steel stud product to terminate bridging into, and a channel, such as channel 205. Holes 435 may be pre-formed in bridging termination clip 400, e.g., at the time of fabrication, or may be formed at a later time, e.g., prior to or during use in the field. Holes 435 may further be formed in legs 415 and/or vertical plate 425.

In one example, bridging termination clip 400 may have the dimensions of about those as indicated in Table 2 below with reference to FIGS. 4A-4E. However, other suitable dimensions less than or greater than those listed below in Table 2 are contemplated.

TABLE 2

| | |
|---|---|
| a | 1⅝" |
| b | 3" |
| c | 3⅝", 4", 6", 8", 10", 12" |
| d | ¾" |
| e | 1½" |
| f | ⅞" |
| g | 3¾" |
| h | ¼" |

Bridging termination clip 400 may be formed of a single piece of sheet steel similar to the material of which a standard steel stud, such as single jamb steel stud 210, double jamb steel stud 310, and/or channel 205 are formed. The sheet may be bent to about a right angle between horizontal channel portion 405 and the vertical plate 425 portions. Other materials, such as, for example, plastics, and other suitable materials, may also be used.

Referring now to FIGS. 5A-5E, illustrates views of a bridging termination clip 500 according to a third embodiment. Bridging termination clip 500 includes a horizontal channel portion 505 which is in the general shape of an inverted "U", which includes a horizontal bridge 510 and opposing legs 515 extending vertically downward from the side edges of bridge 510 in perpendicular relation thereto. Horizontal channel portion 505 preferably has a width between legs 515 that is substantially equal to or slightly greater than the width of channel 205, such that channel 205 can fit between legs 515.

Bridging termination clip 500 may further include a vertical plate 525 extending vertically upward from a rear portion of horizontal bridge 510 and is oriented substantially perpendicular thereto. Vertical plate 525 may further include opposing side extensions 530 extending rearward, one from each side edge of vertical plate 525 and oriented substantially perpendicular thereto. The spacing between side extensions 530 maybe substantially equal to or slightly greater than the width (e.g., outer or inner width) of a steel stud, such as single jamb steel stud 210, double jamb steel stud 310, or any other steel stud product to terminate bridging into, e.g., in the range of about 3⅝ inches to about 12 inches, such as, 3⅝ inches, 4 inches, 6 inches, 8 inches, 10 inches, 12 inches, or other width less than 3⅝ inches or greater than 12 inches, as required by a particular steel stud application.

Bridging termination clip 500 may further include one or more holes 535 in horizontal bridge 510 and/or side extensions 530. Holes 535 may be sized for the insertion of fasteners, e.g., screws, rivets, or the like for securing termination clip 500 to a steel stud, such as single jamb steel stud 210, double jamb steel stud 310, or any other steel stud product to terminate bridging into. Termination clip 100 is preferably secured to a steel stud, and a channel, such as channel 205. Holes 535 may be pre-formed in bridging termination clip 500, e.g., at the time of fabrication, or may be formed at a later time, e.g., prior to or during use in the field. Holes 535 may further be formed in legs 515 and/or vertical plate 525.

In one example, bridging termination clip 500 may have the dimensions of about those as indicated in Table 3 below with reference to FIGS. 5A-5E. However, other suitable dimensions less than or greater than those listed below in Table 3 are contemplated.

TABLE 3

| | |
|---|---|
| a | 1⅝" |
| b | 3" |
| c | 3⅝", 4", 6", 8" 10", 12" |
| d | ¾" |
| e | 1½" |
| f | ⅞" |
| g | 3¾" |
| h | ¼" |

Bridging termination clip 500 may be formed of a single piece of sheet steel similar to the material of which a standard steel stud, such as single jamb steel stud 210, double jamb steel stud 310, and/or channel 205 are formed. The sheet may be bent to about a right angle between horizontal channel portion 505 and the vertical plate 525 portions. Other materials, such as, for example, plastics, and other suitable materials, may also be used.

Referring now to FIGS. 6A-6G, illustrate views of a bridge termination clip 600 according to a fourth embodiment. Bridging termination clip 600 includes a horizontal channel portion 605 which is in the general shape of an inverted "V", which includes a peak 610 and legs 615 angled downward from the peak 610, wherein the legs 615 may be angled at about 45 degrees from vertical center of peak 610, and about 90 degrees relative to one another. Horizontal channel portion 605 preferably has dimensions between legs 615 that are substantially equal to or slightly greater than the dimensions of a spazzer bar 620, such that the spazzer bar 620 can be accommodated between legs 615.

Bridging termination clip 600 may further include a vertical plate 625 extending vertically upward from a rear portion of horizontal channel portion 605 and is oriented substantially perpendicular thereto. Bridging termination clip 600 may further include one or more welded joints 627 at the abutment of the vertical plate 625 and the horizontal channel portion 605. In one example, the welded joints 627 runs along an edge of each of legs 615 where it abuts with vertical plate 625. Vertical plate 625 may further include opposing side extensions 630 extending rearward, one from each side of vertical plate 625 and oriented substantially perpendicular thereto. The spacing between side extensions 630 maybe substantially equal to or slightly greater than the width (e.g., outer or inner width) of a steel stud, such as single jamb steel stud 210, double jamb steel stud 310, or any other steel stud product to terminate bridging into, e.g., in the range of about 3⅝ inches to about 12 inches, such as, 3⅝ inches, 4 inches, 6 inches, 8 inches, 10 inches, 12 inches, or other width less than 3⅝ inches or greater than 12 inches, as required by a particular steel stud application.

Bridging termination clip 600 may further include one or more holes 635 in legs 615 and/or side extensions 630, which may be sized for the insertion of fasteners, e.g., screws, rivets, or the like for securing bridging termination clip 600 to a stud, such as single jamb steel stud 210, double jamb steel stud 310, or any other steel stud product to terminate bridging into, and a spazzer bar, such as spazzer bar 620. Holes 635 may be pre-formed in bridging termination clip 600, e.g., at the time of fabrication, or may be formed at a later time, e.g., prior to or during use in the field. Holes 635 may further be formed in legs 615 and/or vertical plate 625.

In one example, bridging termination clip 600 may have the dimensions of about those as indicated in Table 4 below with reference to FIGS. 6A-6G. However, other suitable dimensions less than or greater than those listed below in Table 4 are contemplated.

TABLE 4

| | |
|---|---|
| a | 1¾" |
| b | 2¼" |
| c | 3⅝", 4", 6", 8", 10", 12" |
| d | ¾" |
| e | 1½" |
| f | 1¼" |
| g | 1¼" |

Bridging termination clip 600 may be formed of a single or multiple pieces of sheet steel similar to the material of which a standard steel stud, such as single jamb steel stud 210, double jamb steel stud 310, and/or spazzer bar 620 are formed. Other materials, such as, for example, plastics, and other suitable materials, may also be used.

Referring now to FIGS. 7A-7B, illustrate views of a portion of a steel channel 205 inserted perpendicularly through openings of two consecutive steel studs 710 and connected to a steel stud at its terminal end via bridging termination clip 100. Channel 205 may be secured to studs 710 via conventional intermediate clips 715, or other suitable type clip/securing mechanism. In other examples, single jamb steel stud 210 may be a double jamb steel stud 310, or any other steel stud product to terminate bridging into, and bridging termination clip 100 may be any one of bridging termination clips 400 or 500. In another example, steel channel 205 may be spazzer bar 620, and bridging termination clip 100 may be bridging termination clip 600.

In operation, a channel 205 is positioned between opposing vertical extensions 120 of bridging termination clip 100 (or with regards to bridging termination clips 400 and 500, between legs 415 and 515 respectively), and secured to bridging termination clip 100 (or 400, 500), by one or more fasteners received through one or more of holes 135 (or 435, 535), of horizontal bridge 110 (or 410, 510), and driven into a top portion of channel 205. Bridging termination clip 100 (or 400, 500), may then be secured to a steel stud, such as single jamb steel stud 210, double jamb steel stud 310, or any other steel stud product to terminate bridging into, by positioning bridging termination clip 100 (or 400, 500), such that vertical plate 125 (or 425, 525), is substantially flush with a front portion of the steel stud, and opposing side extensions 130 (or 430, 530), are positioned on opposing side portions thereof. One or more fasteners may then be received through one or more of holes 135 (or 435, 535), of opposing side extensions 130 (or 430, 530), and driven into opposing side portions of the steel stud. Alternatively, bridging termination clip 100 (or 400, 500), may be first secured to the steel stud, e.g., steel stud 210, and then secured to channel 205.

In another example of operation, a spazzer bar 620 may be positioned between angled legs 615, and secured to bridging termination clip 600 by one or more fasteners received through one or more of holes 635 of legs 615, and driven into spazzer bar 620. Bridging termination clip 600 may then be secured to a steel stud, such as single jamb steel stud 210, double jamb steel stud 310, or any other steel stud product to terminate bridging into, by positioning bridging termination clip 600 such that vertical plate 625 is substantially flush with a front portion of the steel stud, and opposing side extensions 630 are positioned on opposing side portions thereof. One or more fasteners may then be received through one or more of holes 635 of opposing side extensions 630 and driven into opposing side portions of the steel stud, e.g., steel stud 210. Alternatively, bridging termination clip 600 may be first secured to the steel stud, and then secured to spazzer bar 620.

While the examples above are offered as first, second, third, and fourth embodiments, it is not to be construed as a limitation of the scope of the invention which will become apparent from the claims appended hereto. Further, with regard to any specific dimensions of termination clips 100, 400, 500, and 600, as well as size, quantity, and type of screw for the connections of termination clips 100, 400, 500, and 600 to jamb studs listed in the FIGS., or any other stud where bridging channel is being terminated into, it is understood that those are listed only for exemplary purposes, and it is contemplated that other dimensions of termination clips 100, 400, 500, and 600 and/or sizes, quantity, and/or types of screws may be used depending on the particular jamb stud/stud dimensions and/or different loading criteria. In some embodiments, a screw may not be required in each of the holes 135, 435, 535, and/or 635 to provide the same structural integrity given the different loading criteria.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

What is claimed is:

1. A bridging termination clip for terminating a bridging channel member into a terminating stud, comprising:

a. a horizontal portion having a bridge plate and a pair of opposing legs, wherein when in an installed configuration the pair of opposing legs extend vertically downward one from each side edge of the bridge plate in a substantially perpendicular relation, and wherein in the installed configuration a portion of a bottom surface of the bridge plate is engageable with a top surface of a web portion of the bridging channel member and each leg of the pair of opposing legs is spaced apart from one another at least a distance sufficient to allow the bridging channel member to be positioned therebetween;

b. a vertical plate connected to a rear portion of the bridge plate, wherein when in an installed configuration the vertical plate extends upward in a substantially perpendicular relation thereto, and wherein when in the installed configuration a rear facing surface of the vertical plate is engageable with an open side portion of the terminating stud opposite a web side portion of the terminating stud;

c. an opposing pair of side extensions connected to the vertical plate, wherein when in an installed configuration the opposing pair of planar side extensions extend rearward one from each side of the vertical plate in a substantially perpendicular relation thereto, and wherein the opposing side extensions are spaced apart from one another a distance equal to or greater than a width of the terminating stud, and in the installed configuration are engageable with an outer facing surface of opposing side flanges extending from opposing side edges of the terminating stud; and wherein the pair of opposing legs extend and diverge along an entire length of the bridge plate from a front portion of the bridge plate to the rear portion of the bridge plate.

2. The bridging termination clip of claim 1, wherein the horizontal portion is generally shaped in the form of an inverted U, wherein the horizontal portion has a length greater than a height of the vertical plate.

3. The bridging termination clip of claim 1, further comprising a set of opposing vertical extensions, wherein each one of the set of the opposing vertical extensions are inset about an equal distant from opposing sides of the bridge plate and extending vertically downward from a bottom surface of the bridge plate in a substantially perpendicular relation thereto, and wherein a spacing between the opposing vertical extensions is slightly greater than a width of the bridging channel member.

4. The bridging termination clip of claim 3, wherein the spacing between each one of the set of opposing vertical extensions is about 1½ inches.

5. The bridging termination clip of claim 1, further comprising one or more holes formed in one or more of the bridge plate, legs, vertical plate, and side extensions.

6. The bridging termination clip of claim 1, wherein the horizontal portion narrows in width along its length.

7. The bridging termination clip of claim 6, wherein the horizontal portion is about 3 inches in length; the width between the opposing pair of side extensions is in the range of about 3⅝ inches to about 12 inches wide; and the width between the opposing legs at its narrowest point is about 1½ inches wide.

8. The bridging termination clip of claim 1, wherein the horizontal portion is substantially the same width along its length.

9. The bridging termination clip of claim 8, wherein the horizontal portion is about 3 inches in length; the width between the opposing pair of side extensions is in the range of about 3⅝ inches to about 12 inches wide; and the width between the opposing legs is about 1½ inches wide.

10. A bridging termination clip for terminating an inverted V shaped bridging channel member into a terminating stud, comprising:

a. a horizontal portion having a pair of legs connected along a peak, wherein when in an installed configuration the legs extend generally downward from the peak at an angle relative to one another to form a generally inverted V shape, and wherein in the installed configuration a bottom surface of the pair of legs engage are engageable with a top surface of the inverted V shaped bridging channel member and the pair of legs create a space therebetween sufficient to allow the inverted V shaped bridging channel member to be positioned therein;

b. a vertical plate connected from a rear portion of the horizontal portion, wherein the peak of the horizontal portion is substantially on the same plane as an upper most edge of the vertical plate, and wherein when in an installed configuration the vertical plate extends in a substantially perpendicular relation to the horizontal portion, and wherein when in the installed configuration a rear facing surface of the vertical plate engages is engageable with an open side portion of the terminating stud opposite a web side portion of the terminating stud; and c. an opposing pair of side extensions connected to the vertical plate, wherein when in an installed configuration the opposing pair of side extensions extend rearward one from each side of the vertical plate in a substantially perpendicular relation thereto, and wherein the opposing side extensions are spaced apart from one another a distance equal to or greater than a width of the terminating stud, and in the installed configuration are engageable with an outer facing surface of opposing side flanges extending from opposing side edges of the web portion of the terminating stud.

11. The bridging termination clip of claim 10, wherein the legs are angled at about 45 degrees relative to a vertical center of the peak.

12. The bridging termination clip of claim 10, further comprising one or more holes formed in one or more of the legs, vertical plate, and side extensions.

13. The bridging termination clip of claim 10, wherein the horizontal portion is about 1½ inches in length; the width between the opposing side extensions is in the range of about 3⅝ inches to about 12 inches wide; and the width between a lower edge of the legs is about 1¾ inches wide.

14. A method of terminating a bridging channel member into a terminating stud using a bridging termination clip, the method comprising:

a. securing a first portion of the bridging termination clip to a terminal end of the bridging channel member;

b. securing a second portion of the bridging termination clip to the terminating stud, wherein a rear facing surface of the second portion engages with an open side portion of the terminating stud opposite a web side portion of the terminating stud, and wherein the bridging termination clip is configured such that an end most portion of the bridging channel does not extend past the web side portion of the terminating stud;

wherein the bridging termination clip comprises:

i. a horizontal portion having a bridge plate and a pair of opposing legs, wherein the legs extend vertically downward one from each side edge of the bridge plate in a substantially perpendicular relation thereto, and wherein a bottom surface of the bridge plate engages with a top surface of a web portion of the bridging channel member and the opposing legs are spaced apart from one another a distance sufficient to allow the bridging channel member to be positioned therebetween;

ii. a vertical plate connected to a rear portion of the bridge plate, wherein the vertical plate extends upward in a substantially perpendicular relation thereto, and wherein a rear facing surface of the vertical plate engages with the open side portion of the terminating stud opposite the web side portion of the terminating stud;

iii. an opposing pair of side extensions connected to the vertical plate, wherein the opposing pair of side extensions extend rearward one from each side of the vertical plate in a substantially perpendicular relation thereto, and wherein the opposing side extensions are spaced apart from one another a distance greater than a width of the terminating stud, and engage with an outer facing surface of opposing side flanges extending from opposing side edges of the web portion of the terminating stud.

15. The method of claim 14, wherein the first portion comprises the horizontal portion and the second portion comprises at least one of the vertical plate and the side extensions.

16. A method of terminating a bridging channel member into a terminating stud using a bridging termination clip, the method comprising:

a. securing a first portion of the bridging termination clip to a terminal end of the bridging channel member;

b. securing a second portion of the bridging termination clip to the terminating stud, wherein a rear facing surface of the second portion engages with an open side portion of the terminating stud opposite a web side portion of the terminating stud, and wherein the bridging termination clip is configured such that an end most portion of the bridging channel does not extend past the web side portion of the terminating stud; and wherein the bridging termination clip comprises:

i. a horizontal portion having a pair of legs connected along a peak, wherein the legs extend generally downward from the peak at an angle relative to one another to form a generally inverted V shape, and wherein a bottom surface of the pair of legs engage with a top surface of the bridging channel member, wherein the bridging channel member has an inverted V shape, and the pair of legs create a space therebetween sufficient to allow the inverted V shaped bridging channel member to be positioned therein;

ii. a vertical plate connected to a rear portion of the horizontal portion, wherein the vertical plate extends upward in a substantially perpendicular relation thereto, and wherein a rear facing surface of the vertical plate engages with an open side portion of the terminating stud opposite a web side portion of the terminating stud;

iii. an opposing pair of side extensions connected to the vertical plate, wherein the opposing pair of side extensions extend rearward one from each side of the vertical plate in a substantially perpendicular relation thereto, and wherein the opposing side extensions are spaced apart from one another a distance equal to or greater than a width of the terminating stud, and engage with an outer facing surface of opposing side flanges extending from opposing side edges of the terminating stud.

17. The method of claim 16, wherein the first portion comprises the horizontal portion and the second portion comprises at least one of the vertical plate and the side extensions.

* * * * *